US005470407A

United States Patent [19]

Griffith et al.

[11] Patent Number: 5,470,407

[45] Date of Patent: Nov. 28, 1995

[54] METHOD OF VARYING RATE OF DETONATION IN AN EXPLOSIVE COMPOSITION

[75] Inventors: George L. Griffith, Bethlehem, Pa.; Ricky T. Vance, Cordova, Ala.

[73] Assignee: Nelson Brothers, Inc., Parrish, Ala.

[21] Appl. No.: 66,650

[22] Filed: May 25, 1993

[51] Int. Cl.[6] ..... D03D 23/00; D03D 43/00

[52] U.S. Cl. ..... 149/109.6; 149/2; 102/313; 102/332

[58] Field of Search ..... 149/2, 21, 46, 149/60, 109.6

[56] References Cited

U.S. PATENT DOCUMENTS 4,181,546 1/1980 Clay ..... 149/21
4,543,137 9/1985 Edamura et al. ..... 149/21
4,820,361 4/1989 McKenzie ..... 149/2
4,919,178 4/1990 Riga et al. ..... 149/2

*Primary Examiner*—Donald P. Walsh
*Assistant Examiner*—Anthony R. Chi
*Attorney, Agent, or Firm*—Burns, Doane, Swecker & Mathis

[57] ABSTRACT

Provided herewith is a method for preparing an explosive composition with an adjusted rate of detonation which matches the rock stratum in which blasting is to occur. The composition is comprised of a mixture of glass microballoons and plastic spheres, which mixture has been found to provide one with adjustable rates of detonation with essentially no significant difference in the carbon, hydrogen, oxygen, nitrogen and water contents or ratios and at the same time with the same overall energy.

12 Claims, 1 Drawing Sheet

FIG. 1
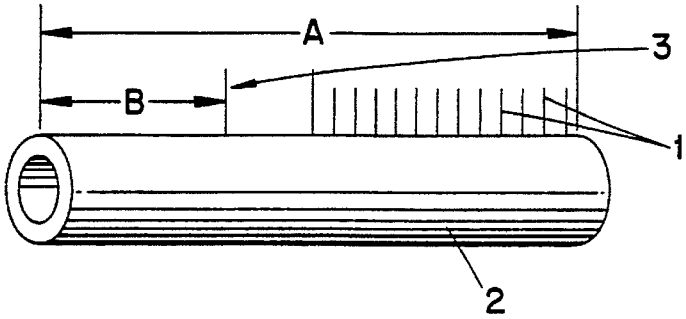
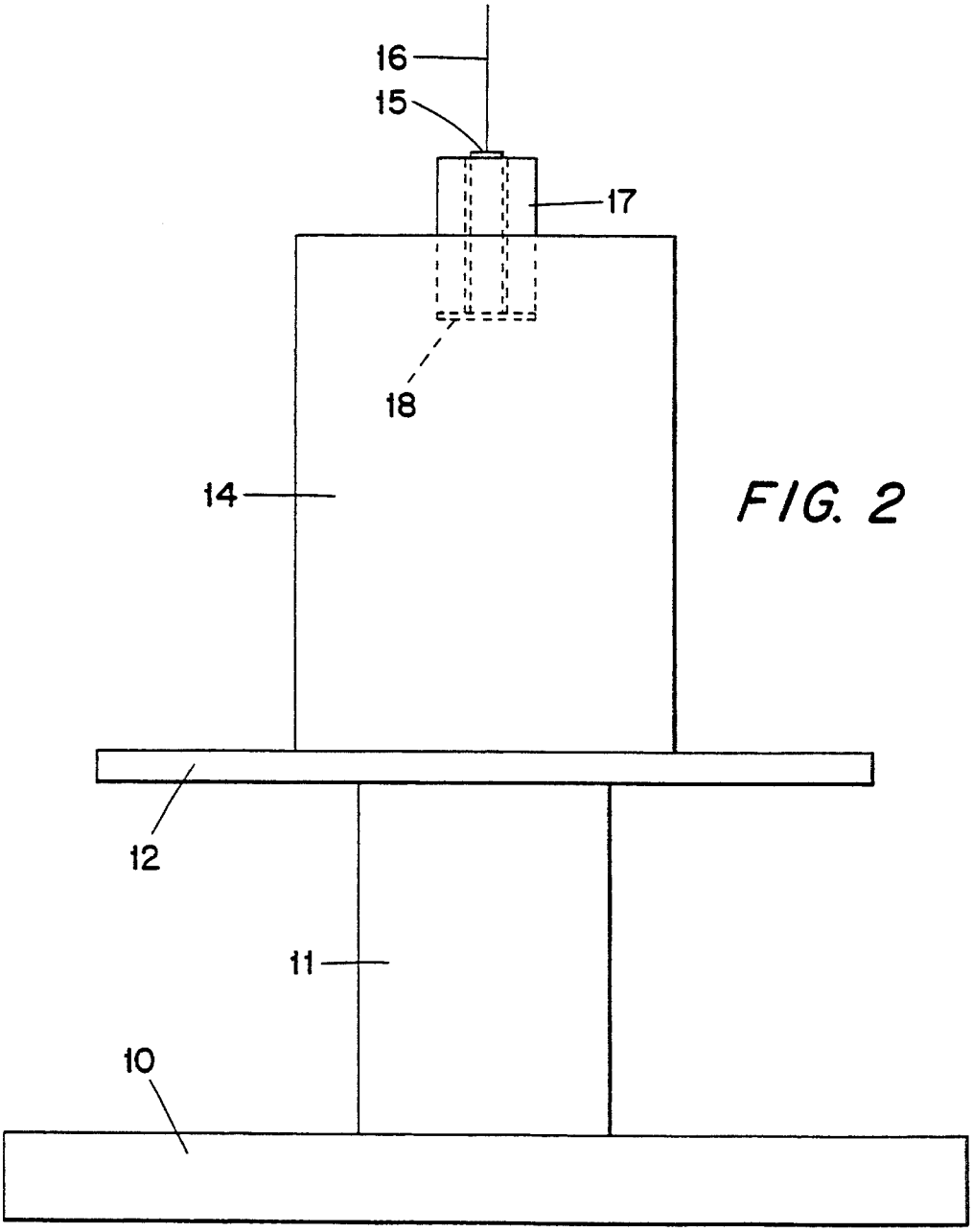
FIG. 2

METHOD OF VARYING RATE OF DETONATION IN AN EXPLOSIVE COMPOSITION

BACKGROUND OF THE INVENTION

The present invention relates to explosives, and in particular explosive emulsions and emulsion/ANFO mixtures. More particularly, the present invention relates to a method of adjusting the rate of detonation for such explosive compositions.

The excavation of rock involves breaking, loading and transportation. Breaking is in most cases accomplished by the use of explosives confined in drill or bore holes or in chambers excavated within the mass of rock to be broken and reached by small tunnels or shafts. It may also be done by undercutting and allowing the weight of the mass to cause caving. Further breaking is caused by the movement of the fallen mass in reaching equilibrium.

The physical characteristics of a rock mass which enter into the breaking problem are the hardness, toughness, brittleness, softness or plasticity of the rock itself and the presence of bedding planes, sheeting planes, joints, cleat or draft in the rock mass. A rock may be both hard and tough or hard and brittle, brittle and soft, soft and plastic, or soft and friable. Soft rocks are easily drilled and broken, while hard tough rocks are difficult to drill and require larger amounts and different kinds of explosives.

The energy of an explosive may be expended in fracturing or shattering a rock mass and in throwing or propelling the broken fragments to a greater or shorter distance. In addition, a certain amount of energy is lost in heating the rock in the immediate vicinity of the charge and in the escape of the gaseous products of the explosion through fissures and seams. The energy expended in breaking and moving the rock mass represents useful work. The property of shattering a rock mass is often referred to as the "disruptive effect", while the property of heaving and throwing is called the "propulsive effect".

The rate of detonation gives a general idea of the disruptive and propulsive effects of a particular explosive. Explosives having a high rate of detonation have a high disruptive effect, while explosives having a very low rate of detonation have a high propulsive effect. For a homogeneous or solid rock mass an explosive of high disruptive effect would be used where the rock is very hard and tough. An explosive of moderate disruptive effect would be used for medium hard and tough rocks, and one of low disruptive effects for soft and brittle rocks. The degree of breaking would be regulated by the amount of powder used and its distribution. For rocks weakened by seams, shear planes and the like, the degree of weakening determines the explosive to be used.

Explosives currently being used in rock blasting situations are generally high shock energy explosives in which all of the explosive energy and the attendant high pressure gases are generated more or less instantaneously. A typical example of such an explosive which is currently used is ANFO, which is a mixture of ammonium nitrate and vegetable and mineral oils with a flash point greater than 140° F., typically diesel oil No. 2. The use of ANFO explosives in many blasting situations results in a number of disadvantages.

As discussed above, an explosive releases energy in two main forms, shock and heave energy. At detonation, there is a sudden increase of pressure that displaces the blast hole wall, generating a strain, or shockwave that produces cracks in the rock. The energy in this wave is of shock energy. After the shockwave is propagated through the rock, the hot pressurized gas which is left in the blast hole is able to extend the cracks as well as to heave the burden. The gas has an energy content referred to as the heave energy. Before blasting, however, rock generally contains sufficient fractures that can be propagated by the heave energy alone. Thus the shock energy serves little or no useful purpose in fractured rock. Furthermore, due to the high shock energy generated by the explosion a greater proportion of fine rock particles are produced by the shock wave. The shock Wave crushes the rock located in close proximity to the bore hole more than is desirable or is required, such as, for use in further processing steps. Minerals or other materials of economic value, such as diamonds, are sometimes damaged by the crushing of diamond bearing rock caused by the shock wave, particularly in locations close to the blast hole.

As a result, the industry has attempted to produce more low shock energy explosives in which more of the energy of the explosive is generated as heave energy and less as shock energy. Such attempts have generally involved dilution of the explosive mixture to produce a lower bulk energy for a given mass of explosive mixture. For example, a mixture of ANFO and sawdust, typically in the ratio of about 2:1, has been utilized. The sawdust acts as a diluent for the ANFO which reduces the density of the explosive mixture. It is well known that the shock energy of an explosive decreases as its density decreases. The problem with reducing the density of the explosive, however, is that in a blast hole the amount of explosive is delimited by the volume of the hole. A low density explosive will not have as much mass in a given volume as a high density explosive. Since the effects of the explosive are related to the amount of explosive in the hole, a low density explosive will not break the rock as effectively as a high density explosive. It would therefore be an advantage to the industry if the heave energy generated could be increased without necessarily lowering the density of the explosive.

In PCT published application WO92/13815, an explosive composition is described which comprises an oxidizing agent such as ammonium nitrate and a fuel material which may include a fuel oil and which comprises a solid fuel such as rubber particles or solid polystyrene beads or flakes. The solid fuel is incorporated into the composition to provide for the controlled release of energy upon detonation of the explosive composition. The published application maintains that by substituting some or all of the liquid fuel oil with a slower burning solid fuel, i.e., the solid rubber particles, the time during which the pressure builds up during detonation is lengthened. Accordingly, a low shock energy explosive is produced having reduced shock energy and increased heave energy compared to conventional explosives such as ANFO.

U.S. Pat. No. 4,820,361 discloses an emulsion explosive containing organic microspheres. The organic microspheres are employed in a water-in-oil explosive emulsion to improve the stability and lower the viscosity. Published Canadian application 2,005,723 also relates to emulsion explosives which includes the sensitizer comprising particles of a compressible material, preferably expanded polystyrene, with said particles having a maximum dimension equal to or less than 3 millimeters, more preferably less than 2 millimeters and most preferably from 0.5% to 7% by volume of the liquid explosive. An alleged advantage afforded by using such sensitizers is that the explosives can be pumped without any significant breakdown of the sensitizing particles, and therefore without unduly affecting the sensitivity of the explosive.

The use of coated thermal plastic microspheres has also been suggested in the prior art. For example, U.S. Pat. No. 4,547,234 describes an explosive composition containing microvoids consisting of thermoplastic resin hollow microspheres coated with a thermosetting resin. The explosive composition is alleged to have a remarkably excellent low temperature detonatability in a small diameter cartridge after lapse of a long period of time. Canadian Patent application 2,042,627 also relates to coating solid additives for water-in-oil and melt-in-fuel emulsion explosives and blasting agents. Described is a coating of a solid which has acid or base sites on its surface with a surfactant having acid or basic characteristics capable of neutralizing the acidic or basic characteristics of the solid surface. Said coating is applied in sufficient quantity to result in neutralization of the acid or base cites on the solid. The result makes the solid additives more compatible with the water-in-oil or melt-in-fuel emulsions and also improves the stability of the water-in-oil emulsion explosives.

The effect of the size of glass microballoons on the detonation velocity of emulsion explosives has been studied, for example, by K. Hattori et al. See, *Journal of the Industrial Explosive Society*, Japan, 1982, volume 43, No. 5, pages 295–301. In a subsequent paper, K. Hattori et al studied the effects of detonation velocity and ballistic mortar value on underwater explosion performance (shock wave energy and bubble energy) using water-in-oil emulsion explosives whose detonation properties were controlled by the particle sizes or contents of microballoon sensitizers. See, Proceedings of the Thirteenth Symposium on Explosives and Pyrotechniques, Dec. 2–4, 1986. The effective particle size of microballoons on detonation velocity and sensitivity of emulsion explosives was also studied by Hattori et al in a paper given at the Proceedings of the Twelfth Symposium on Explosives and Pyrotechniques, Mar. 13–15, 1984. Glass or silica microballoons of sizes ranging from 33 microns to 566 microns were used in the study. It was concluded that under unconfined conditions, the detonation velocity showed a strong dependency on the microballoon particle size. In contrast, detonation velocity in a confined case, corresponding to infinite explosive diameter, turned out to be practically independent of the particle size.

To date, however, no one has yet achieved an easy and efficient manner of adjusting the rate of detonation of a particular explosive composition without adversely affecting, e.g., decreasing, the density of the explosive composition and/or adversely affecting the sensitivity of the explosive composition. A method and explosive composition which would afford such flexibility would certainly be a great advantage in the technology of blasting.

Accordingly, an object of the present invention is to provide a method for easily and efficiently adjusting the rate of detonation of an explosive composition.

Another object of the present invention is to provide a method for adjusting the rate of detonation of an explosive emulsion composition without detrimentally decreasing the density of the composition.

Still another object of the present invention is to provide an explosive composition which is matched in its rate of detonation with the rock in which it is to be used.

Still another object of the present invention is to provide a method for preparing such a composition which has an adjusted rate of detonation, yet has an effective density and sensitivity as well.

These and other objects of the present invention will become apparent upon a review of the following specification, the drawing, and the claims appended thereto.

SUMMARY OF THE INVENTION

In accordance with the foregoing objectives, provided herewith is a method for preparing an explosive composition with an adjusted rate of detonation which matches the rock stratum in which blasting is to occur. The composition is comprised of a mixture of glass microballoons and plastic spheres, which mixture has been found to provide one with adjustable rates of detonation with essentially no significant difference in the carbon, hydrogen, oxygen, nitrogen and water contents or ratios and at the same time with the same overall energy.

It has been found that by employing a mixture of glass microballoons and plastic spheres, and adjusting the ratio or composition of said mixture, one can easily adjust the rate of detonation of the explosion to match that required for a particular rock stratum. Such adjustments can be made directly at the site, if necessary. In any event, the proper explosive combination can be formulated on the fly to give the blaster who has to deal with rock stratums ranging from hard to soft a flexibility which leads to better blasting efficiencies and better blasting effectiveness, as well as better economics, than has been possible to date. The present invention has been found to be particularly effective for emulsion explosives and mixtures of emulsion explosives with ANFO.

BRIEF DESCRIPTION OF THE DRAWING

FIG. 1 is a depiction of the apparatus used to measure the average rate of detonation in the examples.

FIG. 2 depicts the experimental setup employed for conducting small lead block tests to measure sensitivity.

DETAILED DESCRIPTION OF THE INVENTION

The present invention relates to an explosive composition which is either a water-in-oil emulsion explosive or a mixture of such an emulsion with ANFO. The water-in-oil emulsion explosive comprises a water immiscible organic fuel as a continuous phase, an emulsified aqueous inorganic oxidizive salt solution as a discontinuous phase, an emulsifier, and a mixture of glass and plastic spheres. With such an emulsion explosive can be mixed, as is conventionally known, ANFO.

The present invention is based in part on the recognition that by adjusting the ratio of glass and plastic hollow spheres used as sensitizers in the explosive emulsion, the ratio of detonation can be adjusted. This adjustment can occur without a change in density, but more importantly is accomplished while maintaining an effective density and sensitivity.

The glass spheres employed are on the average of a size ranging from about 30 microns to 150 microns, and more preferably in the range of from about 40–80 microns. The plastic spheres are generally on the average of from 200 to 1200 microns in size, more preferably about 400 to about 1000 microns in size, and most preferably in the range of from about 400 to 500 microns in size. The hollow plastic spheres can be of any suitable resin or plastic, but are preferably made of expanded polystyrene. In fact, most commercially available hollow plastic spheres are made of expanded polystyrene.

The plastic spheres can also comprise extremely large spherical particles, such as commercially available expanded polystyrene spherical particles under the trademark DYLITE, which are preferably employed to lower the sensitivity and density of the overall explosive composition. Such oversized resin, and preferably expanded polystyrene, spherical particles, are generally about 2 millimeters in diameter and 3 millimeters long. Such large resin spherical particles have been found very useful for controlling the sensitivity of an explosive emulsion, and has been found very useful when used together with the glass and plastic spheres described above.

The immiscible organic fuel forming the continuous phase of the composition is generally present in an amount of from about 3% to about 15%, and preferably in an amount of from about 4% to about 8% by weight of the composition. The actual amount used can be varied depending upon the particular immiscible fuel(s) used and upon the presence of other fuels, if any. The immiscible organic fuels can be aliphatic, alicyclic, and/or aromatic and can be saturated and/or unsaturated, so long as they are liquid at the formulation temperature. Preferred fuels include tall oil, mineral oil, waxes, paraffin oils, benzene, toluene, xylenes, mixtures of liquid hydrocarbons generally referred to as petroleum distillates such as gasoline, kerosene and diesel fuels, and vegetable oils such as corn oil, cottonseed oil, peanut oil, and soybean oil. Particularly preferred liquid fuels are mineral oil., No. 2 fuel oil, paraffin waxes, microcrystalline waxes, and mixtures thereof. Aliphatic and aromatic nitrocompounds also can be used. Mixtures of the above can used. Waxes must be liquid at the formulation temperature.

Optionally, and in addition to the immiscible liquid organic fuel, solid or other liquid fuels or both can be employed in selected amounts. Examples of solid fuels which can be used are finely divided aluminum particles; finely divided carbonaceous materials such as gilsonite or coal; finely divided vegetable grain such as wheat; and sulfur. Miscible liquid fuels, also functioning as liquid extenders, are listed below. These additional solid and/or liquid fuels can be added generally in amounts ranging up to 15% by weight., If desired, undissolved oxidizer salt can be added to the composition along with any solid or liquid fuels.

The inorganic oxidizer salt solution forming the discontinuous phase of the explosive generally comprises inorganic oxidizer salt in an amount of from about 45% to about 95% by weight of the total composition, and water and/or water-miscible organic liquids, in an amount of from about 2% to about 30%. The oxidizer salt preferably is primarily ammonium nitrate, but other salts may be used preferably in amounts up to about 20%. The other oxidizer salts are selected from the group consisting of ammonium, alkali and alkaline earth metal nitrates, chlorates and perchlorates. Of these, sodium nitrate (SN) and calcium nitrate (CN) are preferred. From about 10% to about 65% of the total oxidizer salt may be added in particle or prill form.

Water generally is employed in an amount of from about 2% to about 30% by weight based on the total composition. It is preferably employed in an amount of from about 10% to about 20%. Water-miscible organic liquids can partially replace water as a solvent for the salts, and such liquids also function as a fuel for the composition. Moreover, certain organic liquids reduce the crystallization temperature of the oxidizer salts in solution. Miscible liquid fuels can include alcohols such as methyl alcohol, glycols such as ethylene glycols, amides such as formamide, and analogous nitrogen-containing liquids. As is well known in the art, the amount and type of liquid(s) used can vary according to desired physical properties.

The emulsifiers of the present invention can be generally any suitable, conventional emulsifier used in water-in-oil explosive emulsions. Preferably, the emulsifiers are derivatives of polypropene and more preferably polyisobutylene, and preferably are used in an amount of from about 0.2% to about 5%. Since most isobutylene feedstocks are contaminated with 1-butene and 2-butene, certain manufacturers use the terms polybutene and polyisobutylene interchangeably or designate polymers derived from predominantly isobutylene feedstocks as "polybutenes". As used herein, the term "polybutene" shall include polyisobutylene. Similarly, the term "polypropene" shall include polypropylene. In emulsifiers prepared from such polymers, the polybutene or polypropene moieties form the hydrophobic ends of the emulsifier molecules. The molecular weights of hydrocarbon chains which are useful in the present application may vary from 300 to 3000, but more preferably are from 500 to 1500 g/mole and particularly preferably from 700 to 1300 g/mole.

Hydrophilic moieties may be attached directly to the terminal double bond on polypropylene or polyisobutylene chains, or may be attached via an intermediate linking group. The type of hydrophilic groups which are effective include acid anhydrides, carboxylic acids, amides, esters, amines, alcohols, oxazolines, imides or combinations thereof.

One preferred type of linking group between hydrophilic and hydrophobic parts of these "polymeric emulsifiers" is succinic anhydride. The terminal olefin on polypropene or polyisobutylene is reacted with maleic anhydride via an "ene" reaction. The resulting polybutenyl or polypropenyl succinic anhydride readily reacts with amines or alcohols to form amides or esters. Depending upon the ratio of reactants and reaction conditions, mixed derivatives are possible. For example, if polybutenyl succinic anhydride is reacted at lower temperatures with one molar equivalent of ethanolamine, ring opening of the anhydride occurs with the formation of amide or ester and carboxylic acid functional groups. Further heating of the products can be done to remove one equivalent of water and form an imide. If two equivalents of ethanolamine are reacted with polybutenyl succinic anhydride with sufficient heat to remove water, bis-amide, bis-ester and mixed amide/ester products are possible.

A second type of linking group for polyisobutylene or polypropylene polymeric emulsifiers is phenol. The terminal olefinic group on polyisobutylene, for example, can be reacted with phenol via a Friedel-Crafts alkylation. Hydrophilic functionality can then be attached to the polyisobutenyl phenol via reaction with formaldehyde and a polyamine such as tetraethylene pentamine.

Direct attachment of hydrophilic groups on polyisobutylene or polypropene can be done in a variety of ways. The terminal olefin on polybutene, for example, can be halogenated. Reaction of the resulting alkyl halide with an amine or polyamine can then be accomplished via bimolecular nucleophilic substitution of halide ion by amine. Similarly, polybutenyl epoxide can be reacted with acids or amines to attach a hydrophilic linking group.

Emulsifiers can be used in the composition of the present invention singly or in various combinations. Besides those conventional emulsifiers described above, other suitable conventional emulsifiers include sorbitan fatty esters, glycol esters, substituted oxazolines, alkyl amines or their salts, derivatives thereof and the like.

The water-in-oil emulsion explosives of the present invention may be formulated in a conventional manner. Typically, the oxidizer salt(s) first is dissolved in the water (or aqueous solution of water and miscible liquid fuel) at an elevated temperature of from about 25° C. to about 90° C., depending upon the crystallization temperature of the salt solution. The aqueous solution is then added to a solution of the emulsifier and the immiscible liquid organic fuel, which solutions preferably are at the same elevated temperature, and the resulting mixture is stirred with sufficient vigor to invert the phases and produce an emulsion of the aqueous solution in a continuous liquid hydrocarbon fuel phase. Usually this can be accomplished essentially instantaneously with rapid stirring. (The compositions also can be prepared by adding the liquid organic to the aqueous solution.) Stirring should be continuous until the formulation is uniform. This premix should then be run through high energy mixers, e.g., static mixers, to decrease the particle size and increase the stability of the emulsion. The solid ingredients, including the glass and plastic microspheres then are added and stirred throughout the formulation by conventional means. The formulation process also can be accomplished in a continuous manner as is known in the art.

It has also been found to be advantageous to predissolve the emulsifier in the liquid organic fuel prior to adding the organic fuel to the aqueous solution. This method allows the emulsion to form quickly and with minimum agitation.

In part, the present invention is predicated upon the discovery that by adjusting the ratio of glass and plastic spheres used, the rate of detonation of an explosive composition can be easily adjusted to the desired sensitivity. More importantly, this adjustment can be made without changing the density of the composition. As well, it has been discovered in the practice of the present invention that by employing a mixture of plastic and glass spheres, one can reduce the density of an explosive composition if desired, while not increasing the sensitivity to unacceptable levels. Rather, the sensitivity likewise can be reduced. This is directly contrary to the understanding of the art that when the density is decreased, the sensitivity will increase.

Accordingly, in the practice of the present invention, one can formulate an explosive composition to have the desired heave energy for the rock formation in issue, but also have the composition be sensitive enough to release its full power based upon the primer used. This can be accomplished by using a greater ratio of plastic/glass spheres, with at least some of the plastic spheres being extremely large spheres of 2 millimeter in diameter.

Part of the advantage of the present invention is that one can easily adjust the glass to plastic sphere ratio by adding it to the water-in-oil emulsion formulation. This addition, as described above, takes place near the end of the formulation, and simply requires addition with stirring. By adding more plastic spheres, for a given density, the number of spheres per cubic centimeter of emulsion will be reduced and thus the rate of detonation will also be reduced, thereby providing an explosive with greater heave energy. Compositions having greater heave energy would be suitable for soft rock where a slow explosive is needed. In order to raise the rate of detonation, one would adjust the ratio of glass to plastic spheres to increase the number of glass spheres added, thereby increasing the number of spheres per cubic centimeter of emulsion, and resultingly increasing the rate of detonation.

One can actually adjust the ratio in order to fine tune the reaction zone length of the explosive to match the sonic velocity of the rock stratum to be blasted. This can be all done while holding the density constant. By altering the ratio of glass to plastic spheres, the spherical density control agent provides a rate of detonation which matches the sonic velocity of the rock to be blasted, preferably within plus or minus 10% of the sonic velocity of the rock. Such adjustment can actually be done on the fly by a blaster since the formulation and addition of the particular amounts of glass to plastic spheres can be made at the site, if desired. The ease of this adjustment also allows one to make adjustments in the explosive as the rock stratum actually changes.

None of this would be possible without the recognition by the present invention of the relationship between the ability to change that rate of detonation by employing a mixture of glass and plastic spheres, with changes in the ratio changing the rate of detonation.

Furthermore, the use of the mixture of glass and plastic spheres also helps to control the sensitivity of the explosive within practical consideration. The use of larger plastic spheres actually have been surprisingly found to desensitize the explosive. This allows one to control the sensitivity so that it is not too great, otherwise it could not be handled with conventional equipment. Nevertheless, it does permit one to tailor the rate of detonation to match the sonic velocity of the rock stratum to be blasted, while permitting a sensitivity sufficient to achieve a full release of power, based upon the particular primer used.

A part of the control of the sensitivity is achieved by using extremely large plastic spherical particles such as that available commercially under the trademark DYLITE. It has been found that the use of DYLITE spherical particles together with the more conventional plastic and glass spheres provides a composition which truly permits fine control of the rate of detonation and sensitivity for a given density of explosive emulsion.

While the present invention has been generally described with regard to explosive emulsions, it should be noted that the present invention also applicable to mixtures of such an emulsion with ANFO. Such mixtures are conventional and can be made using conventional techniques. The present invention, however, would generally require the use of a mixture of glass and plastic spheres, with its adjustment being made when the water-in-oil explosive emulsion is formulated as described above.

The present invention will be illustrated in greater detail by the following specific examples. It is understood that these examples are given by way of illustration and are not meant to limit the disclosure of the claims to follow. All percentages in the examples, and elsewhere in the specification, are by weight unless otherwise specified.

EXAMPLE 1

The rates of detonation for various explosive cartridges were determined. Differing cartridges having different diameters were used, as were different cartridges with different densities. The ratio of glass to plastic spheres was also a variable that was tested. The plastic spheres employed were standard expanded polystyrene spheres having an average size of about 760 microns which translates to a bulk density of 4 pounds per cubic foot. The glass spheres employed had an average size of about 55 microns. The emulsion explosive employed in each case involved a composition containing 76.4% ammonium nitrate, 15.64% water, 1% emulsifier and 7% of a hydrocarbon fuel.

The detonation velocities (rates of detonation) were measured using a standard pin probe/oscilloscope method employing the setup shown in FIG. 1. In this method pins manufactured by using rigid coaxial cable were cut to finite lengths. These pins 1 were placed at equal spacings of one inch along a cartridge of explosive 2 to be tested. A starter pin 3 was also placed in the cartridge. Generally, the length of the cartridge A was 24 inches. The distance B from the starter pin 3 to the end of the cartridge was about 12 inches.

A center wire of the coaxial cables were connected via a pulse forming network to an R 2000 rapid system digital oscilloscope interfaced to a 286 computer. The outer cable of the rigid coaxial cable was connected to ground. This allowed for the pins to be shorted as the detonation front moved down the cartridge and produced a signal pulse that was recorded on the oscilloscope. The detonation velocities were then calculated according to the formula:

V=distance between pins/time between pulses (feet/seconds).

This method of wiring detonation velocities is very accurate and is well known by those in the explosives industry.

TABLE 1

| Cartridge | | Average Rate of Detonation in Feet/Second | | | | |
|---|---|---|---|---|---|---|
| | | Ratio of Glass to Plastic Spheres | | | | |
| Diameter (inches) | Density (g/c.c.) | 100% Glass | 75% Glass/ 25% Plastic | 50%/50% | 25% Glass/ 75% Plastic | 100% Plastic |
| 2 | 0.8 | 14100 | 13500 | 13400 | 13400 | 12400 |
| 3 | 0.8 | 14300 | 14000 | 14000 | 14000 | 13700 |
| 4 | 0.8 | 14600 | 14600 | 14400 | 14200 | 14300 |
| 6 | 0.8 | 15300 | 15700 | — | — | 14800 |
| 2 | 1.0 | 17300 | 16700 | 15900 | 14800 | 12700 |
| 3 | 1.0 | 18000 | 17800 | 17100 | 15600 | 14400 |
| 4 | 1.0 | 18500 | 18200 | 17500 | 16800 | 15400 |
| 6 | 1.0 | 18500 | 18600 | 17600 | 17700 | 16500 |
| 2 | 1.25 | 15000 | 12900 | failed | failed | failed |
| 3 | 1.25 | 18100 | 15000 | 12900 | 12100 | failed |
| 4 | 1.25 | 19200 | 17200 | 15300 | failed | failed |
| 6 | 1.25 | 19900 | 19500 | 17100 | 17100 | 12600 |
| 6.75 | 0.6 | — | — | — | — | 9100 |

EXAMPLE 2

Using the lead block deformation test, various explosive compositions were tested for sensitivity. The setup employed is shown in FIG. 2.

The setup employs a baseplate 10 which is about 3 inches thick. A lead cylinder 11 is placed on top of the baseplate, with the lead cylinder being about 2 inches across and 4 inches high. A three-quarter inch driver plate 12 is placed on top of the lead cylinder. A cartridge 14 full of explosive emulsion such as that described in Example 1 is placed upon the driver plate, with this cartridge being about 6⅜ inches in height and 3⅜ inches wide. Into the emulsion is hung a number 8 Ensign Bickford detonation cap 15 by cable 16. The cap is placed in a wooden dowel 17 which is drilled out with a hole for the cap 15. The wooden dowel is either 0.75 inch, 1 inch or 1.25 inches in diameter. Since none of the products tested were cap sensitive, a Detasheet was necessary to detonate the charge. The Detasheet 18 was placed at the bottom of the wooden dowel with cap end 15 in contact with the Detasheet. The Detasheet was a plastic bonded sheet explosive about 3/16 of an inch thick with the same diameter as the dowel.

The results of the tests are recorded below in Table 2.

TABLE 2

| Density (g/cc) | Ratio of Glass/Plastic Sphere | Deformation in Lead Block (inches) | Sensitivity Minimum Dia. to Detasheet (inches) |
|---|---|---|---|
| 1 | 100% glass | 2.56 | 0.75 |
| 1 | 75/25 | 2.39 | 0.75 |
| 1 | 50/50 | 2.2 | 0.75 |
| 1 | 100% plastic | 2.65 | 1.25 |
| 0.8 | 100% glass | 2.56 | 0.75 |
| 0.8 | 75/25 | 2.39 | 0.75 |
| 0.8 | 50/50 | 2.20 | 0.75 |
| 0.8 | 100% plastic | 2.65 | 1.25 |

EXAMPLE 3

Using the same setup of Example 2, formulations using DYLITE spheres were tested for their sensitivity. The results were recorded in the following table.

TABLE 3

| Density (g/cc) | DYLITE (wt %) | Plastic (wt %) | Glass (wt %) | Sensitivity to Detasheet (inches) |
|---|---|---|---|---|
| 0.8 | 50 | 50 | — | 1.25 - no go |
| 0.8 | 50 | — | 50 | 0.75 - go |

The foregoing examples illustrate that by using different amounts and combinations of polystyrene and glass sensitizers, sensitivity could actually be controlled to a high degree.

EXAMPLE 4

The following runs measure the rates of detonation for various explosives packaged in a 6 inch diameter plastic cartridge. The cartridges were confined in a 7⅜ inch diameter bore hole. The rate of detonation was measured using the same setup as depicted in FIG. 1. The type of explosive, sensitizer used and the resulting rate of detonation are shown in the Table below:

TABLE 4

| Explosive | Sensitizer | ROD (ft/sec) |
|---|---|---|
| Emulsion | plastic | 14,177 |
| Emulsion | glass | 18,500 |
| 50% Emulsion/50% ANFO | glass | 16,307 |
| 50% Emulsion/50% ANFO | plastic | 14,001 |
| 40% Emulsion/60% ANFO | glass | 15,179 |
| 40% Emulsion/60% ANFO | plastic | 12,779 |

In the foregoing runs, the emulsion explosive involved a water-in-oil emulsion comprised of 76.4 weight percent ammonium nitrate, 15.64% water, 1% emulsifier and 7% of a hydrocarbon fuel. The glass sensitizers used were glass hollow spheres having a size of about 55 microns. The plastic sensitizers were hollow plastic spheres of expanded polystyrene having a size of about 760 microns and a bulk density of about 4 pounds per cubic foot.

The foregoing data demonstrates that by using larger spheres, namely plastic spheres, one can actually change the rate of detonation.

EXAMPLE 5

Single 7⅜ inch diameter bore holes were loaded with various explosives and shot. The distance from the hole at the toe to the free face was carefully measured, and then the face velocity of the rock moving away from the face was measured. These measurements showed that more throw energy was being developed by explosives having the same density —the same pounds per foot of explosives, but different confined rates of detonation. The results are given in the Table below:

TABLE 5

| Explosive | ROD (ft/sec) | Top Face Velocity (ft/sec) | Bottom Face Velocity (ft/sec) | Toe Burden (feet) |
|---|---|---|---|---|
| 50% Emulsion/50% ANFO - sensitized with all glass spheres in size of 50–100 microns | 16,750 | 17.4 | 27.2 | 25.6 |
| Emulsion - sensitized with 2 lb/ft$^3$ expanded polystyrene spheres | 15,850 | 20.9 | 29.8 | 37.6 |
| Emulsion - sensitized with 4 lb/ft$^3$ expanded polystyrene spheres | 15,000 | 25.1 | 27.9 | 36.6 |

The water-in-oil explosive emulsion was the same as that described in Example 3. The top burden was about 25 feet in the foregoing tests.

The results in the foregoing Table demonstrate that as the rate of detonation of the explosive decreases, for this particular type of rock, the face velocity of the rock throw increases somewhat even though the burden on the two lower velocity emulsion products was significantly higher. In other words, the sonic velocity of the rock being shot was being more nearly matched, so one could throw the rock the same with less explosive despite the same burden. This is shown as with increased burden, the bottom face velocity stayed constant and the top velocity increased.

While the invention has been described with preferred embodiments, it is to be understood that variations and modifications may be resorted to as will be apparent to those skilled in the art. Such variations and modifications are to be considered within the purview and the scope of the claims appended hereto.

What is claimed:

1. A process of making an explosive composition, which comprises (1) determining the desired rate of detonation, and (2) formulating a water-in-oil explosive emulsion by combining a water immiscible organic fuel continuous phase, emulsified aqueous inorganic oxidizer salt solution discontinuous phase, emulsifier, and mixture of glass and plastic microspheres, with the mixture of glass and microspheres being adjusted to provide the desired rate of detonation.

2. The process of claim 1, wherein the water-in-oil emulsion is combined with ANFO.

3. The process of claim 1 wherein the desired rate of detonation is below 17,000 feet per second.

4. The process of claim 1 wherein the desired rate of detonation is in the range of from about 9,000 to 20,000 feet per second.

5. The process of claim 1 wherein the desired rate of detonation is in the range of from about 9,000 to about 16,800 feet per second.

6. The process of claim 1 wherein the ratio of glass to plastic spheres is about 50% glass to 50% by weight plastic spheres.

7. The process of claim 1, wherein the ratio of glass to plastic spheres ranges from about 5% glass to 95% plastic to about 95% glass to 5% plastic.

8. A method for blasting which comprises (1) determining the rock sonic velocity of the rock stratum to be blasted (2) and preparing a water-in-oil explosive emulsion by mixing therein a sensitizer comprised of a mixture of glass and plastic hollow spheres, with the particular mixture of glass and plastic hollow spheres providing a rate of detonation which matches the sonic velocity of the rock.

9. The method of claim 8, wherein the density of the water-in-oil explosive emulsion is in the range of from about 0.6 to 1.25 g/cc.

10. The method of claim 8, wherein the explosive emulsion is not cap sensitive to a number 8 blasting cap.

11. The process of claim 8, wherein the plastic spheres have an average size of from 400 to 500 microns, and the glass spheres have a size ranging from about 50 to 60 microns, and the weight ratio of glass to plastic spheres is about 50/50.

12. The method of claim 11, wherein the mixture of glass and plastic spheres further comprises DYLITE spheres.

* * * * *